United States Patent [19]

Schrantz et al.

[11] 4,062,568

[45] Dec. 13, 1977

[54] METHOD AND MEANS FOR TRANSCRIBING MEDICAL TEST DATA

[76] Inventors: Robert D. Schrantz; Janice R. Johnson, both of P.O. Box F, Ottumwa, Iowa 52501

[21] Appl. No.: 595,522

[22] Filed: July 14, 1975

[51] Int. Cl.[2] ..... B42D 11/00; B42D 12/00; B42D 15/00

[52] U.S. Cl. ..... 283/66 R; 282/29 B

[58] Field of Search ..... 283/66, 63 A; 282/29 A, 282/29 B, 29

[56] References Cited

U.S. PATENT DOCUMENTS

| | | | |
|---|---|---|---|
| 1,442,266 | 1/1923 | Graham et al. | 283/66 A |
| 1,588,185 | 6/1926 | Groby | 283/66 R |
| 1,979,283 | 11/1934 | Osborn | 283/66 R |
| 2,435,684 | 2/1948 | Jones | 282/29 B |
| 3,236,542 | 2/1966 | Russell | 282/29 B |

FOREIGN PATENT DOCUMENTS

| | | | |
|---|---|---|---|
| 676,528 | 7/1952 | United Kingdom | 283/66 R |

*Primary Examiner*—Stephen C. Pellegrino

*Attorney, Agent, or Firm*—Larley, McKee, Thomte & Voorhees

[57] ABSTRACT

The method of the present invention comprises placing a test result printout on a work sheet having a grid thereon comprising a vertical and horizontal matrix of columns and rows. The rows are sized and spaced to register with the individual indicia in the column of indicia on the test printout. After the indicia on the test printout are aligned and registered with the horizontal rows on the work sheet, the indicia are transcribed from the printout to the work sheet. A data slip is then laid over the work sheet. The data slip has a horizontal row of boxes sized and spaced to register with a group of columns on the work sheet. The data slip is positioned so that the row of boxes is adjacent one of the horizontal rows on the work sheet and is registered with the columns within said group. The indicia in the columns are then transcribed from the columns to the boxes. Finally, the data slips are adhered to a patient chart in a shingled fashion so that the boxes of each data slip are exposed on the lower shingled edge of the data slip.

6 Claims, 6 Drawing Figures

METHOD AND MEANS FOR TRANSCRIBING MEDICAL TEST DATA

SUMMARY OF THE INVENTION

This invention relates to a method and means for transcribing medical test data.

Whenever a patient is admitted to a hospital, much of the patient's first day or two in the hospital is spent taking samples for tests and conducting tests which will be used by the physician for diagnostic purposes. The test samples are normally taken shortly after the patient is admitted to the hospital, and the test results are usually available for the physician by the second day. Often times the physician orders a second group of tests after seeing the res ults from the first group. This second group requires an additional day or two before the results are available to the doctor. Thus it is often the case that a patient spends two or more days in the hospital while tests are being conducted and before any treatment can begin.

Recently discreet analyzers have been utilized to conduct a plurality of tests at once. These discreet analyzers can be programmed to conduct one test on a plurality of samples all at once thereby increasing the speed and reducing the expense of the tests. Examples of such instruments are the Abbott Bichromatic Analyzer 100 manufactured by Abbott Scientific Products Division, South Pasadena, California, and the Programachem 1040 manufactured by American Monitor Corporation, Post Office Box 68505, Indianapolis, Indiana 46268.

These discreet analyzers have permitted the pathology departments of hospitals to conduct all conceivable diagnostic tests at once so that upon the second day the doctor has available to him the test results of all tests which he might conceivably use for diagnosis. This eliminates the necessity of having a second or third group of tests run after the initial group of tests in order to diagnose the patient's problem.

However, certain problems are encountered in transcribing the test result data produced by these discreet analyzers into a form which can be readily used by the doctor on the patient's chart. Transcribing voluminous test results is presently a very time-consuming chore. Furthermore, extreme care must be taken to prevent errors in the transcribing. Even when extreme care is used, present methods result in a normal error rate of from 2 to 4%. Also, it is very difficult to check or proof read the transcribing efforts under present methods.

The present invention utilizes a work sheet having columns which are sized and shaped to correspond to the column of indicia on the printout which is produced by the discreet analyzers. Data slips are then provided which have a row of boxes sizes to correspond with a group of columns on the work sheet. The data slip is overlaid over the work sheet and the indicia on the work sheet are transcribed readily to the data slip. The data slips are then shingled on the patient's chart so that the data is readily available and visible to the doctor. This method involved two transcriptions. The first transcription is from the printout to the work sheet and the second transcription is from the work sheet to the data slips. In tests conducted with respect to 17,000 transcribed indicia, an error rate of 0.02% was found in the first transcription and an error rate of 0.0016% was found in the second transcription. Furthermore, checking and proof reading the transcription is far earier with the present method than with previous methods.

Therefore, a primary object of the present invention is the provision of a method and means for transcribing medical test data which permit quick and accurate transcribing of test data from discreet analyzers.

A further object of the present invention is the provision of a method and means which permit data to be displayed in a form easily viewed by a doctor.

A further object of the present invention is the provision of a method and means which can easily be adapted for a single battery of diagnostic tests or for a sequence of monitoring tests which are repeated periodically.

A further object of the present invention is the provision of a method and means for transcribing test data which can be easily checked and proof read to find errors.

BRIEF DESCRIPTION OF THE FIGURES OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings in which:

DETAILED DESCRIPTION OF THE DRAWINGS

Figure 1:
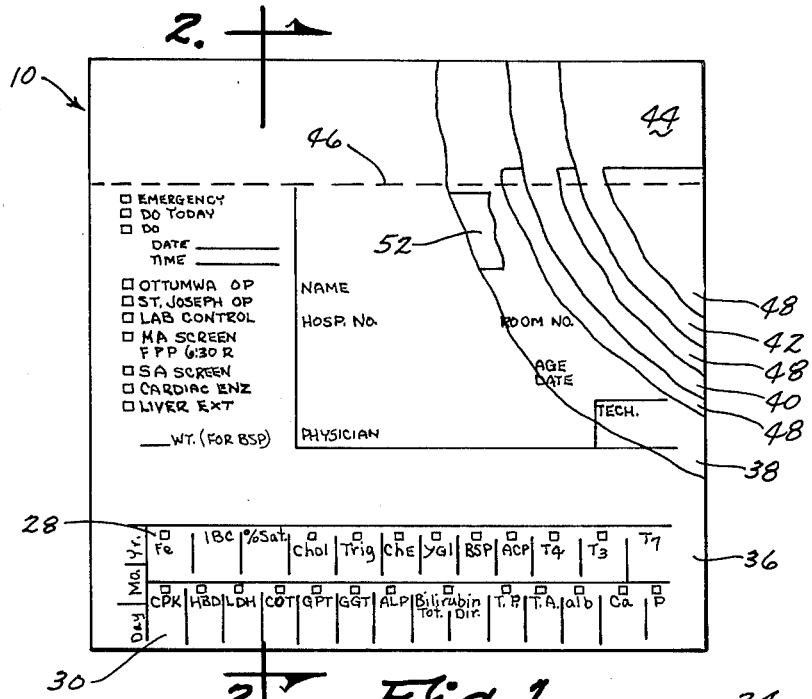
FIG. 1 is a plan view of a data slip used with the present invention, portions of said slip being cut away.

Referring to the drawings, the present method is practiced with the use of a data slip 10, a work sheet 12, a machine test data printout 14, a diagnostic patient chart 16 and a monitoring patient chart 18.

Figure 3:
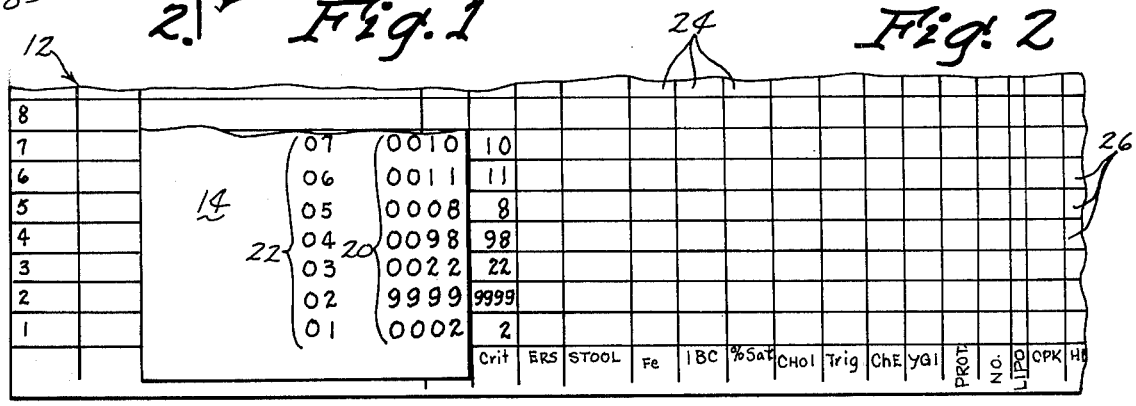
FIG. 3 is a partial view of the work sheet used for the present invention showing a test data printout overlaid thereon.
Figure 4:
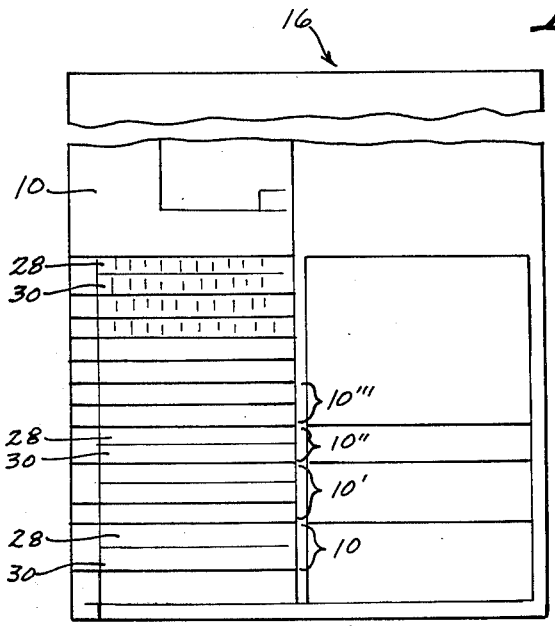
FIG. 4 is a view of a patient's chart having a plurality of data slips shingled thereon to display diagnostic test results.
Figure 5:
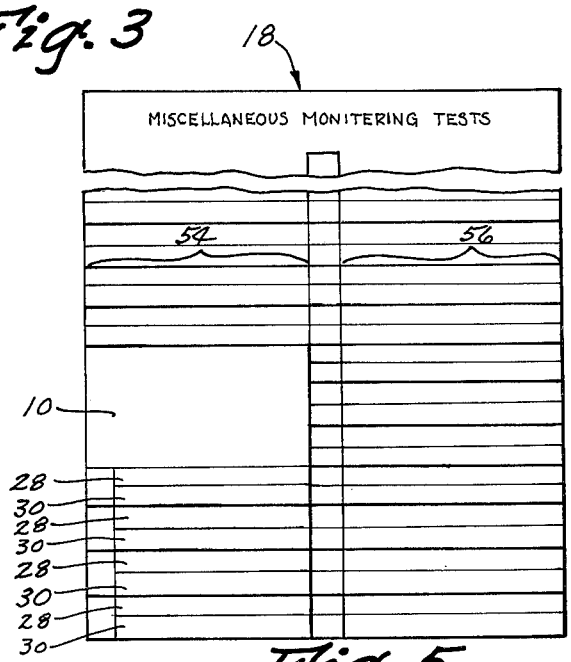
FIG. 5 is a view similar to FIG. 4 showing data slips shingled for displaying the results of monitoring tests.

Printout 14 is produced by the discreet analyzers described above and includes a column of test data indicia each of which includes a machine identifying indicia 22 associated therewith. Each machine number identifies the test data indicia which corresponds to a given specimen which has been tested. Thus when a plurality of specimens are tested by a discreet analyzer each machine number identifies the specimen number to which the test data indicia relate. For example, referring to FIG. 3 of the drawings, the numeral "01" on printout 14 refers to specimen #1, and the test data indicia immediately to the right thereof indicate the test results for that particular specimen.

Work sheet 12 includes a matrix of test result columns 24 and horizontal patient rows 26. At the time the specimens are inserted into the discreet analyzer, the machine number of each specimen is written in the left most column of work sheet 12. Also, the patient's name and an arbitrary number assigned to each patient are written at the left hand of work sheet 12. Thus each horizontal row 26 corresponds to a particular patient, and each box within that row corresponds to a different test which can be performed with respect to that patient. The various columns are labeled at the top and the bottom to identify the test results which should be placed in each particular column. The size and spacing of horizontal rows 26 is chosen so as to correspond to the size and spacing of each indicia within column 20 on printout 14. Thus printout 14 can be overlaid on work sheet 12 so that the machine numbers 22 and the test data 20 associated therewith are in registered alignment with the horizontal rows on work sheet 12 which correspond to the same machine numbers. Then printout 14 is aligned with its right hand edge adjacent the column pertaining to the test which is reflected on printout 14. For example, in FIG. 3 the test labeled "Crit" is the test corresponding to the data reflected on printout 14.

Once printout 14 has been aligned with the appropriate column and has been placed in registered alignment so that the machine numbers on printout 14 are registered with the machine numbers on work sheet 12, it is a simple matter to transcribe the test data indicia from printout 14 to work sheet 12. This is repeated for each test printout which is produced by the discreet analyzer until all the columns for each of the tests have been filled out on the work sheet.

Figure 6:
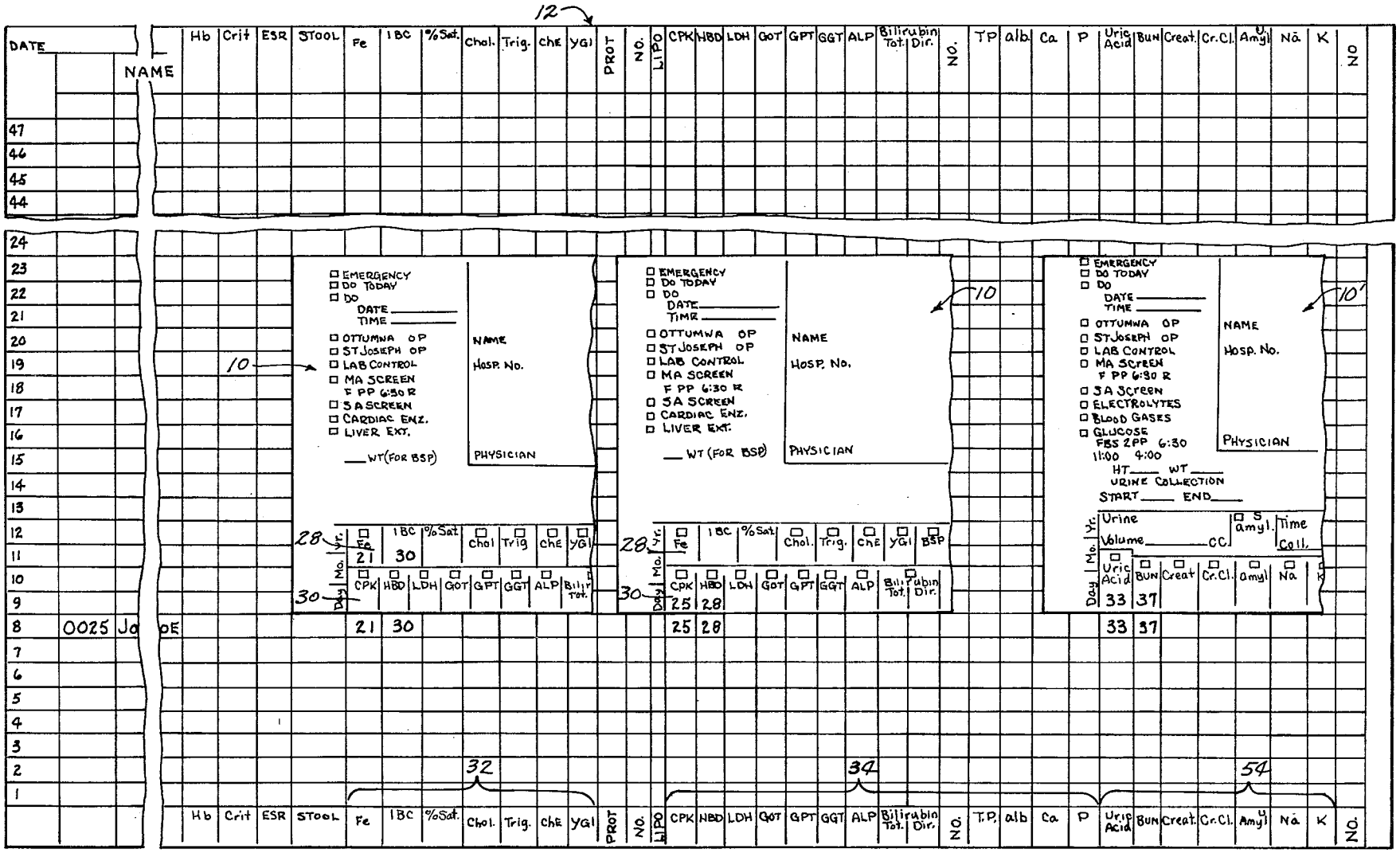
FIG. 6 is a view of a work sheet, showing the data slips overlaid thereon.

After the data has been transcribed from the printout to the work sheet, it is then necessary to transcribe the test data from the work sheet 12 to data slips 10. This is accomplished as shown in FIG. 6. Each data slip 10 includes first and second horizontal rows 28, 30 adjacent its lower edge. These boxes are sized and spaced to correspond respectively to groups 32, 34 of columns indicated on work sheet 12. For example, the first box in row 28 is labeled Fe, and this box corresponds to a similarly labeled column in group 32 on work sheet 12. Similarly, the second box is labeled IBC, and this box corresponds to a corresponding column on work sheet 12. Similarly, each box in row 30 corresponds to a column in group 34.

In order to transcribe the data from work sheet 12 to data slips 10, one merely aligns data slips 10 above the horizontal row of a given patient with each box in row 28 on data slip 10 in registered alignment with the particular columns in group 32 to which it pertains. For example, referring to FIG. 6, data slip 10 is aligned with horizontal row 8, with horizontal row designated by the machine number 8, and with the boxes in row 28 in registered alignment with group 32 of columns shown on work sheet 12. It is then a simple matter to transcribe the data from work sheet 12 into the appropriate boxes 28 on data slip 10.

After row 28 of boxes on data slip 10 have been filled, data slip 10 is moved so that row 30 is in registered alignment with the columns in group 34 as shown in the middle of FIG. 6. The data is again transcribed from row designated by machine #8 to row 30 of boxes on data slip 10.

Figure 2:
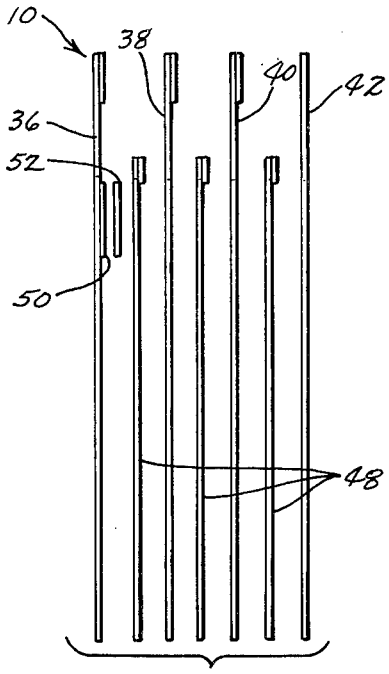
FIG. 2 is an exploded sectional view taken along line 2—2 of FIG. 1.

Data slip 10 includes several sheet members 36, 38, 40 and 42 as shown in FIG. 2 which are joined at the top portion 44 above a perforated line 46. A plurality of carbon sheets 48 are interposed between the various sheet members 36, 38, 40 and 42. Front sheet member 36 includes an adhesive substance 50 on its back surface adjacent and immediately below perforated line 46. Adhesive substance 50 incl udes a cover 52 which prevents the adhesive from adhering to anything until after cover 52 is removed.

After data has been transcribed from work sheet 12 to data sheets 10, the data sheets are torn along perforated line 46 and the various sheet members 36, 38, 40 and 42 are separated. Front sheet member 36 is then adhered to a patient diagnostic chart 16 by removing cover 52 from adhesive substance 50 and by adhering substance 50 to diagnostic chart 16. A second data slip 10' is shown in FIG. 6 and includes boxes thereon which correspond to an additional group 54 of columns on work sheet 12. Data is transcribed from work sheet 12 to data sheet 10' in the same fashion as is described for data slips 10. Data slip 10' is then separated and adhered to diagnostic sheet 16 immediately above data slip 10 and in shingled fashion so that rows 28, 30 of data slip 10 are exposed below rows 28, 30 of data slip 10'.

Additional work sheets are utilized corresponding to additional tests and similarly data slips are used to transcribe the data therefrom. All of the data slips are then shingled on diagnostic chart 16 in the manner described above.

The data slips may also be used to record a sequence of monitoring tests which are conducted when a patient is undergoing treatment. For example, when treating a patient for diabetes, it is common that tests are run periodically to determine how the patient is responding to treatment. The various dosages of treatment which are given to the patient are in a large part determined by the test results shown after the previous dosage.

Accordingly, monitoring chart 18 shows how data slips 10 can be used to record a sequence of monitoring tests. Each time the test is run the data slip is fastened in the left hand column 54 of monitor chart 18. Each time a test is run, a new data slip is added so that the shingled data slips 10 reveal the test results from each test taken. A right hand column 56 provides a space for the nurse or doctor to add notes with respect to dosages which were given corresponding to the various tests. For example, the dosages of treatment may change from time to time depending upon the test results and these changes are recorded in the right hand column 56.

The above described method and means provide an extremely accurate means for transcribing test data from printout 14. Because the printout can be placed immediately adjacent the columns to which the data is being transcribed and because the rows in the columns correspond in size and spacing to the various indicia on the printout, the person transcribing the data has little difficulty in properly aligning and transcribing. Furthermore, it is quick and easy to check the transcribing merely by placing the printout adjacent the column to which it pertains in comparing the numbers visually.

Similarly, the transcribing of the data from the work sheet to the data slips is also quick, easy and accurate. Because the data slips may be placed immediately above the rows bearing the data to be transcribed, there is little room for error. Furthermore, they may be checked quickly by merely placing the data slip along the row and registering the boxes on the data slip with the columns to which they pertain. In testing more than 17,000 transcriptions, it has been found that only 4 errors occurred, an error rate of approximately 0.02% in the first transcribing process. The second transcribing process resulted in even higher accuracy with only one error out of 17,000 transcriptions. This is to be compared with the normal error rate of 2–4% incurred in present methods. Thus it can be seen that the device accomplishes at least all of its stated objectives.

What is claimed is:

1. A method for transcribing medical test data from a test result printout, said test result printout having a column of equally spaced indicia, each of said indicia including a patient identifying indicia and a test result indicia, said method comprising:

placing said test result printout on a work sheet having a grid thereon comprising a plurality of vertical columns each of which corresponds to a different test and a plurality of horizontal rows each of which corresponds to a different patient, said rows being sized and spaced to register with said column of indicia on said test result printout;

aligning said patient identifying indicia with said horizontal rows so that said patient identifying indicia are registered with the rows corresponding to the patient they identify;

aligning said test result indicia beside the one column corresponding to the test represented by said test result indicia;

transcribing the test result indicia from said printout to said one column;

aligning a plurality of test result printouts in a similar fashion beside the columns corresponding to the test results thereon and transcribing said test result indicia from said printouts to said columns whereby each horizontal row will reflect the test result indicia for various tests run for one patient;

overlaying a data slip on said work sheet, said data slip having a horizontal row of boxes sized and spaced to register with a first group of said columns on said work sheet;

positioning said data slip on said work sheet so that a row of boxes is adjacent one of said horizontal rows and registered with said group of columns; and transcribing the indicia in both said one horizontal row and in said group of columns to said boxes of said data slip.

2. A method according to claim 1 comprising overlaying a plurality of other data slips on said work sheet, each of said data slips having boxes which correspond in size and spacing to a different group of columns aligning each data slip with its respective columns, transcribing data from a single horizontal row onto said other data slips so that said data slips reflect test data for a single patient.

3. A method according to claim 2 comprising shingling said data slips on a patient chart so that said boxes on each data slip are on an exposed shingled edge.

4. A method according to claim 3 comprising shingling a plurality of data slips, each of which reflect different test data.

5. A method according to claim 3 comprising shingling a plurality of data slips which reflect test data from a plurality of identical tests taken sequentially on specimens from the same patient.

6. A method according to claim 5 wherein said data slips are shingled in a vertical column on a chart and patient treatment data is written on said chart adjacent and laterally of the lower edge of each data slip.

* * * * *